US008715056B2

(12) United States Patent
Kumbhat et al.

(10) Patent No.: US 8,715,056 B2
(45) Date of Patent: May 6, 2014

(54) PLAYER INTERACTIVE LOTTERY

(75) Inventors: Abhishek Kumbhat, New Delhi (IN); Sugal Prasan Chand Jain, New Delhi (IN)

(73) Assignee: Skilrock Technologies Pvt. Ltd., New Delhi (IN)

( * ) Notice: Subject to any disclaimer, the term of this patent is extended or adjusted under 35 U.S.C. 154(b) by 47 days.

(21) Appl. No.: 13/124,548

(22) PCT Filed: Oct. 16, 2008

(86) PCT No.: PCT/IN2008/000680

§ 371 (c)(1),
(2), (4) Date: Apr. 15, 2011

(87) PCT Pub. No.: WO2010/044090

PCT Pub. Date: Apr. 22, 2010

(65) Prior Publication Data

US 2011/0201401 A1 Aug. 18, 2011

(51) Int. Cl.
*G07F 17/32* (2006.01)

(52) U.S. Cl.
CPC ..... *G07F 17/329* (2013.01); *G07F 17/3295* (2013.01)
USPC ..... 463/17

(58) Field of Classification Search
CPC ..... G07F 17/329; G07F 17/3295
USPC ..... 463/17
See application file for complete search history.

(56) References Cited

U.S. PATENT DOCUMENTS

| | | | | | |
|---|---|---|---|---|---|
| 3,918,174 | A * | 11/1975 | Miller et al. | 434/346 |
| 4,491,319 | A * | 1/1985 | Nelson | 273/459 |
| 4,652,998 | A * | 3/1987 | Koza et al. | 463/26 |
| 6,203,011 | B1 | 3/2001 | Nulph | |
| 6,435,500 | B2 * | 8/2002 | Gumina | 273/139 |
| 2003/0050109 | A1 | 3/2003 | Caro et al. | |
| 2007/0178969 | A1 * | 8/2007 | Luciano et al. | 463/42 |
| 2010/0227658 | A1 * | 9/2010 | Crowder et al. | 463/1 |
| 2010/0301555 | A1 * | 12/2010 | Jubinville et al. | 273/139 |
| 2011/0039621 | A1 * | 2/2011 | Steene et al. | 463/42 |

* cited by examiner

*Primary Examiner* — Corbett B Coburn
(74) *Attorney, Agent, or Firm* — Sughrue Mion, PLLC

(57) ABSTRACT

Systems and methods of conducting a player interactive lottery are described. In an implementation, winning of a player is decided for a lottery ticket the moment the player purchases the lottery ticket. A set of player objects is identified by incorporating at least one interactive game to be played by the player for the lottery ticket, wherein the set of player objects is identified based on skill of the player to play the interactive game. A set of winning objects can be disclosed to the player for the lottery ticket through the interactive game. The set of winning objects can be disclosed based on the set of player objects, the decided winning of the player for the lottery ticket, and winning criteria. The decided winning can be disclosed to the player based on the set of player objects, the set of winning objects, and the winning criteria.

7 Claims, 5 Drawing Sheets

PLAYER INTERACTIVE LOTTERY

FIELD OF INVENTION

The present invention relates to systems and methods for conducting a player interactive lottery and more particularly to a player interactive lottery incorporating skill based interactive games.

BACKGROUND OF THE INVENTION

A lottery can typically be defined as a game of chance. With an increasing popularity and demand for lottery games, instant lottery games, in particular, are gaining immense recognition and acceptance in the lottery industry. Instant lottery games, also referred to as instant games hereinafter, are such lotteries in which the winning of a player is decided before or at the time of purchase of the lottery ticket and the winning information is instant.

An instant lottery game can be represented as a combination of a lottery object defining the chance of winning the lottery and a player interactivity object to define the level of player interactivity that the lottery demands from a player. Instant lottery games can typically be divided into three types of instant games, wherein the division can be done based on such instant games that have the same common lottery object which decides the chance of winning of a player but have different levels of player interactivity. The first type is a scratch paper lottery. In the scratch paper lottery, a player scratches a paper lottery ticket to determine instantly whether he has a winning ticket or not. Such scratch paper lottery games lack the desired player involvement in terms of playing experience and become monotonous as scratching tickets is primarily a mechanical job from a player's perspective.

The second type is a Personal Computer and/or a Mobile instant lottery. This lottery provides a much improved platform for players to play instant lottery by giving the players a platform to purchase and play instant lottery online. Although this type of lottery increases the level of player interactivity, the main advantage lies in the availability of games anywhere anytime. In such games, a player typically has to generate an event through the PC/Mobile user interface to determine his/her winning. Such events can be through click of a button or a link or any other action that may generate an event which then determines the winning of the player for one or more lottery tickets. However, such games too, lack user interactivity and fail to generate any interest in the player. These games make the process of playing instant lottery games mechanical as all that a player needs to do is to generate an event by means of a click and/or any other event generation mechanism. This is specially the case for players in the age group of 18-35 who live in the age of video games and expect interactivity with the underlying gaming system to generate interest. These games do not demand any skill from the player to play the instant lottery.

The third type relates to an interactive lottery. Multiple interactive lotteries comprising of skill based interactive games have been disclosed in past wherein winning of a player is determined through a display of skill of the player to play the skill based interactive games. US2007202939 discloses such a skill based interactive game, wherein winning of a player, in addition to being dependent on chance, also depends on the skill displayed by the player to play the interactive game. Incorporation of skill as a determining factor in deciding the winning of a player, side-steps from the inherent purpose of playing lotteries, as lotteries should depend only on the chance factor. Further, most of the interactive lotteries, while making the player play interactive, games, fail to disclose the method in which player objects and winning objects of the lotteries are disclosed to the player and then compared with each other to disclose the winning of the player, wherein the winning of the player is decided at the moment the player purchases the ticket.

This background information is provided for the purpose of making known information believed by the applicant to be of possible relevance to the present invention. No admission is necessarily intended, nor should be construed, that any of the preceding information constituted prior art against the present invention.

In view of the foregoing it can be seen that systems and methods are needed for conducting a player interactive lottery, inducing a player to take more active part in the lottery through the use of his/her gaming skills, which would make the lottery more interesting and interactive.

OBJECTS OF THE INVENTION

It is an object of the invention to provide systems and methods for conducting a player interactive lottery to make instant lottery games more interesting and interactive for players.

It is another object of the invention to provide a player interactive lottery which includes multiple interactive games with different winning odds and prize distribution schemes.

It is yet another object of the invention to provide a player interactive lottery having one or more interactive games to be played based on skill of a player to play the games.

It is yet another object of the invention to provide a player interactive lottery, wherein outcome of the lottery is independent of skill displayed by a player to play interactive game(s) incorporated in the player interactive lottery.

It is yet another object of the invention to provide a player interactive lottery which incorporates intelligence in one or more interactive games so as to generate such outcome from the interactive games that disclose the same winning as is decided the moment the player purchases the ticket.

SUMMARY OF THE INVENTION

This summary is provided to introduce simplified concepts of conducting a player interactive lottery, which is further described below in the Detailed Description. This summary is not intended to identify essential features of the claimed subject matter, nor is it intended for use in determining the scope of the claimed subject matter.

Implementations and embodiments of conducting a player interactive lottery are described. In one implementation, winning of a player is decided for a lottery ticket of the player interactive lottery the moment the player purchases the lottery ticket. A set of player objects, also collectively referred to as a player set, is identified by incorporating at least one interactive game to be played by the player for the lottery ticket. The set of player objects is identified based on an outcome of the interactive game, wherein the outcome of the interactive game is based on skill of the player to play the interactive game. A set of winning objects can be disclosed to the player for the lottery ticket through the interactive game. The set of winning objects can be disclosed based on a combination of the set of player objects, the decided winning of the player for the lottery ticket, and winning criteria. The winning decided the moment the player purchases the lottery ticket can be disclosed to the player based on the set of player objects, the set of winning objects, and the winning criteria.

In another embodiment, winning of a player is decided for a lottery ticket of the player interactive lottery the moment the player purchases the lottery ticket. A set of player objects for a lottery ticket are determined the moment the player purchases the lottery ticket, wherein the set of player objects is based on winning criteria and the decided winning. In an embodiment, a set of winning objects can also be determined based on the winning criteria. The set of winning objects can be determined such that on a comparison of the set of player objects and the set of winning objects, based on the winning criteria, the same winning as decided the moment the lottery ticket is purchased by the player, is disclosed. The set of player objects can be revealed to the player by incorporating at least one interactive game to be played by the player for the lottery ticket, wherein the set of player objects is revealed upon a set of actions by the player. Such set of actions by the player are based on skill of the player to play the interactive game. The winning decided the moment the player purchases the lottery ticket can then finally be disclosed to the player based on the set of player objects and the winning criteria.

In an embodiment, the set of player objects and the set of winning objects in the player interactive lottery can be based on various objects including numbers, symbols, letters, sportive symbols, events, and other interactive objects. The disclosed systems and methods of conducting the player interactive lottery can be implemented through a combination of one or more media such as an electronic media, a PC/Mobile device, a computing based device, and a paper.

This summary is provided to introduce a selection of concepts in a simplified form to be further described below in the Detailed Description. This summary is not intended to identity key features or essential features of the claimed subject matter, nor is it intended to be used to limit the scope of the claimed subject matter.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION OF THE INVENTION

This disclosure is directed to techniques for conducting a player interactive lottery game. More particularly, the disclosure relates to techniques for conducting a player interactive lottery incorporating skill based interactive games.

The details disclosed below are provided to describe the following embodiments in a manner sufficient to enable a person skilled in the relevant art to make and use the disclosed embodiments. Several of the details described below, however, may not be necessary to practice certain embodiments of the invention. Additionally, the invention can include other embodiments that are within the scope of the claims but are not described in detail with respect to the following description. In the following section, an exemplary environment that is suitable for practicing various implementations is described. After this discussion, representative implementations of systems, devices, and processes for conducting a player interactive lottery are described.

Exemplary Computing Environment

Figure 1:
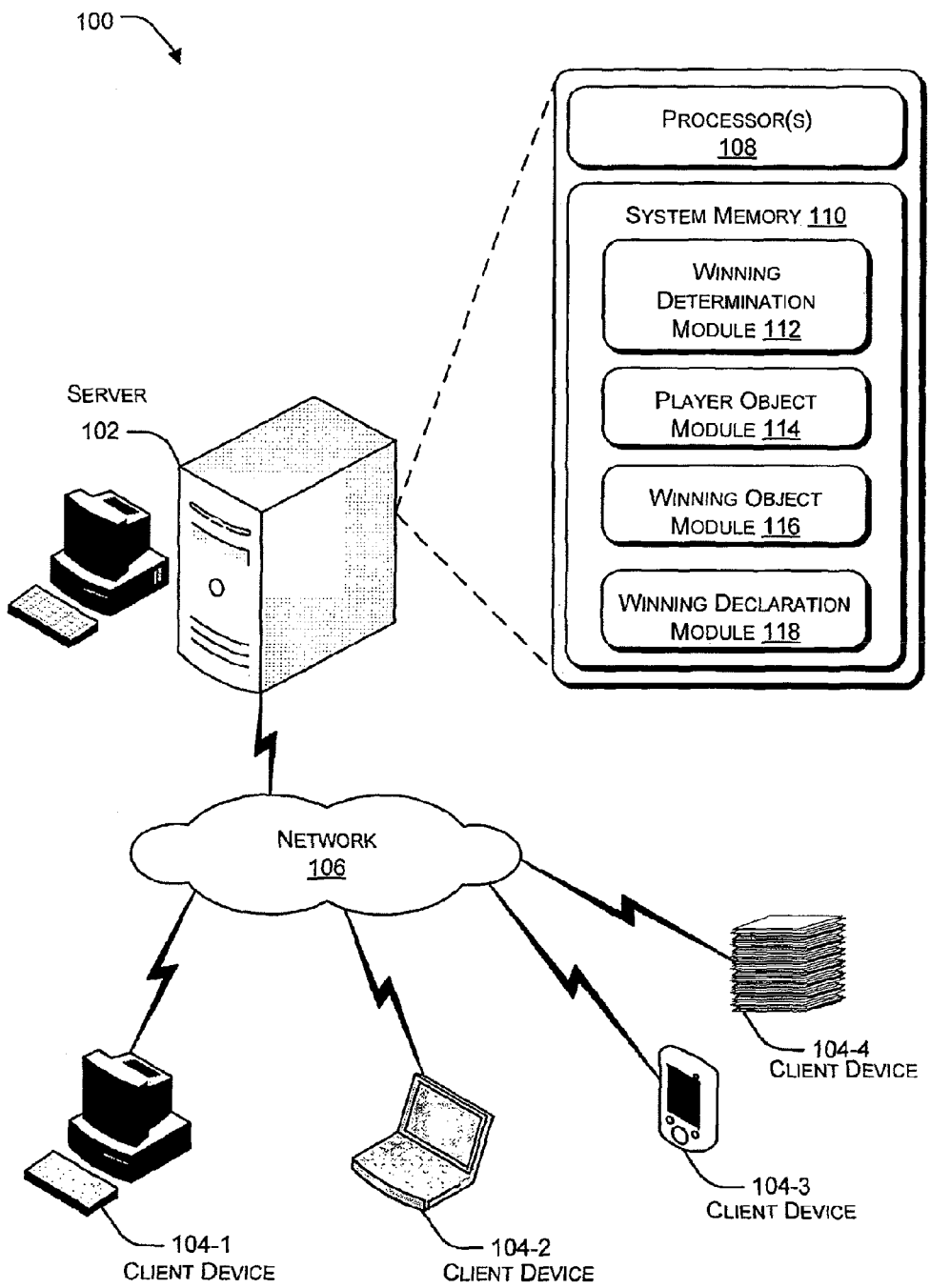
FIG. 1 illustrates an exemplary computing environment implementing techniques for conducting a player interactive lottery.

FIG. 1 illustrates an exemplary computing environment 100 that is suitable for implementing techniques for conducting a player interactive lottery through one or more interactive games that demand skill from a player to play the games. Outcome of the one or more interactive games do not impact the winning of the player but are incorporated to make instant lottery games interesting and interactive. The player interactive lottery incorporates intelligence in the interactive games such that based on the skill of the player to play the interactive games, the player interactive lottery adapts the interactive games to disclose the same winning for a lottery ticket to the player as was determined the moment the player purchased the lottery ticket. For discussion purposes, the environment 100 can be a system with a server 102 accessible by one or more client devices 104-1, 104-2 . . . **104-*n*, collectively referred to as client devices 104 hereinafter, communicatively linked to each other and to the server 102 through a network 106**.

The server 102 can be implemented as a variety of conventional computing devices, including, for example, a server computer, a desktop computer, a notebook or portable computer, a workstation, a mainframe computer, a mobile computing device, an Internet appliance, a network router, etc. or a combination thereof that are configurable to conduct the player interactive lottery for one or more players using the network 106.

The client device 104 can be implemented as a variety of conventional computing devices, including, for example, a server computer, a desktop PC, a notebook or portable computer, a workstation, a mainframe computer, a mobile computing device, an Internet appliance, a network router, a paper, a voice client device (e.g. a telephone or a mobile phone), a POS terminal, other types of handheld devices, an Internet appliance, a network router, Wi-Fi and WiMax enabled devices etc. or a combination thereof that are configurable to purchase lottery tickets and play the player interactive lottery using the server 102 and present winning of the lottery for the lottery tickets to the player using the network 106.

The network 106 can be a wireless or a wired network, or a combination thereof. The network 106 can be a collection of individual networks, interconnected with each other and functioning as a single large network (e.g., the Internet or an intranet). Examples of such individual networks include, but are not limited to, Local Area Networks (LANs), Wide Area Networks (WANs), and Metropolitan Area Networks (MANs). Further, the individual networks may be wireless or wired networks, or a combination thereof.

In one embodiment, the server 102 includes a processor 108 coupled to a memory 110. The memory 110 includes a winning determination module 112, a player object module 114, a winning object module 116, and a winning declaration module 118. The memory 110 may be coupled to, associated with, and/or accessible to other devices, such as network servers, routers, and/or other servers 102.

The winning determination module 112 decides winning of a player for a lottery ticket of a player interactive lottery.

The winning of the player is decided the moment the player purchases the lottery ticket. The decided winning is then disclosed to the player by means of one or more interactive games that the player plays for determining his/her winning for the ticket of the player interactive lottery.

The player object module 114 identifies a set of player objects for each lottery ticket by incorporating at least one interactive game to be played by the player for the lottery ticket. The interactive games can include multiple media-based interactive sporting and/or other events such as, but not limited to, a pool game, a volleyball game, a football game, a tennis game, a race (run, car, and bike), a throw game, and a golf game. The set of player objects, also referred to as a player set hereinafter, are identified based on an outcome of the interactive game where the outcome of the interactive game is based on skill of the player to play the interactive game. In an embodiment, the interactive game for a particular lottery ticket of the player interactive lottery can be based on a throw ball game, wherein on each throw of the player playing the lottery, a player object is generated based on the skill of the player to throw the ball using skills such as timing, angle of throw, and other expected skills.

The winning object module 116 discloses a set of winning objects to the player for the lottery ticket. The set of winning objects, also referred to as a winning set hereinafter, can be disclosed through the interactive game using which the player object module 114 determines a set of player objects. In an embodiment, the player objects and the winning objects can be selected from, but are not limited to, numbers, symbols, letters, sportive symbols, events, and interactive objects. The set of winning objects can be disclosed based on the set of player objects identified by the player object module 114, the winning of the player for the lottery ticket decided by the winning determination module 112, and winning criteria.

The winning criteria can include a set of criterion based on which the set of player objects is either with the set of winning objects or the set of player objects is matched with a winning criterion to determine the winning for the player. For example, the winning criteria can be based on equality of player objects and winning objects, or player objects higher than winning objects, or matching of winning symbols and player symbols, or winning numbers less than player numbers, or number of same player numbers in the player set.

In an embodiment, the player interactive lottery includes a throw ball based interactive game. The winning criterion is based on player numbers higher than winning numbers, wherein a player participating in the player interactive lottery wins the lottery when his/her player numbers are higher than winning numbers. Consider that the player and the winning sets include 5 numbers in each set and the winning determination module 112 decides the winning of a player for a specific lottery ticket as $500 for matching the winning criterion for three numbers the moment the player purchases the lottery ticket.

In another embodiment, a winning amount can also be declared by the winner determination module 112 for each throw of the player i.e. for each player number. The player numbers can then be added to finalize the total winning of the lottery ticket.

The player can play the interactive game by throwing the ball as far as possible based on his/her skills to play the game. The player object module 114 can for each throw identify a player number based on how far the ball has been thrown by the player. The winning object module 116 can then for each player number disclose a winning number based on the player number, the winning decided by the winning determination module 112, and the winning criterion. In an embodiment, the winning object module 116 discloses the winning number against each player number through a dealer that, through the interactive throw ball game throws the ball to such distance that discloses the winning number. The dealer therefore throws the ball in such a manner that taking into consideration the player numbers and the winning criterion, the winning decided by the winning determination module 112 is achieved. For example, to win a prize amount of $500, if the player numbers are {34, 39, 54, 58, 20}, the winning numbers can be {23, 37, 59, 63, 12}.

The winning declaration module 118 declares winning decided by the winning determination module 112 to a player for a lottery ticket. In an embodiment, the winning can be declared to the player after the interactive game and can be declared based on the player set, the winning set, and the winning criteria. In another embodiment, the winning can also be declared while playing the interactive game.

In an embodiment, winning of a player for a lottery ticket of a player interactive lottery is determined by the winning determination module 112 the moment the player purchases the lottery ticket. The winning of the player is not dependent on the skill of the player to play one or more interactive games incorporated in the player interactive lottery. Promotional money, gifts in kind or in monetary terms may however be given by the lottery agency conducting the player interactive lottery to the player based on the skill of the player to play the interactive game.

In another embodiment, an automatic play option can be given to a player while playing a player interactive lottery. Using the automatic play option, the player can skip one or more interactive games incorporated in the player interactive lottery to determine the winning for the lottery ticket, which is determined by the winning determination module 112. The automatic play option can be selected by the player if the interactive game does not interest the player and/or the player does not possess the skills required to play the interactive game.

In another embodiment, the player interactive lottery can be played using interfaces such as, but not limited to, an electronic media, a personal computer, a computing device, a mobile device, and a paper.

Exemplary working of the server 102 and the various modules in the system memory 110 are now described in detail with reference to FIG. 2.

Figure 2:
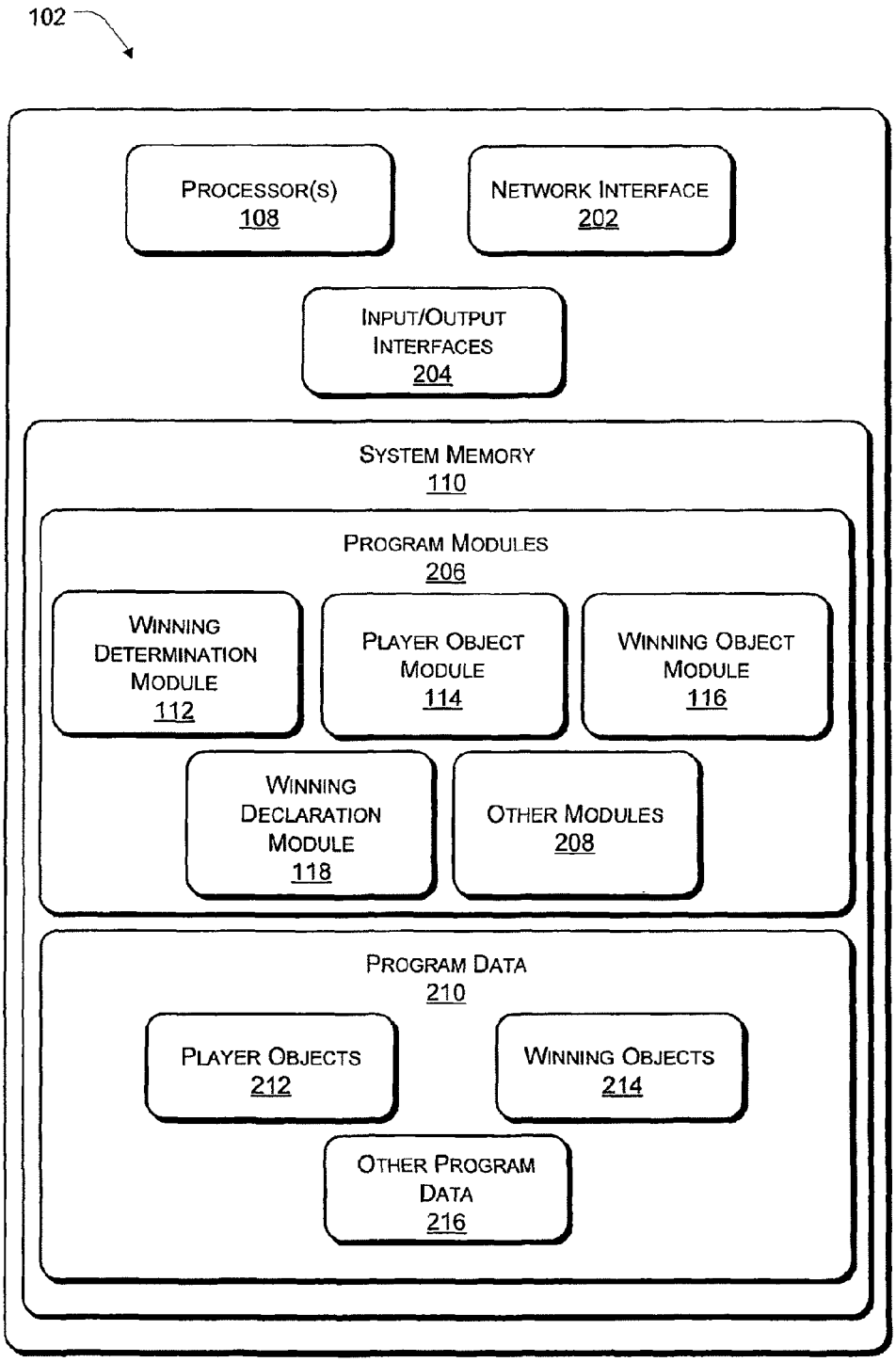
FIG. 2 illustrates an exemplary computing device architecture for conducting a player interactive lottery.

FIG. 2 shows an exemplary server architecture for conducting a player interactive lottery. In one embodiment, the server 102 can include, but is not limited to, a processor(s) 108, a network interface(s) 202, a system memory 110, and an Input/Output Interface(s) 204.

The network interface 202 enables the server 102 to receive player requests for purchase of lottery tickets for the player interactive lottery. The network interface 202 can also receive requests from players to play the player interactive lottery and can transfer the request to the server 102. The network interface 202 can further interact with the server and transfer the winning information along with the associated prize amount, if any, to the one or more players.

The memory 110 includes computer-readable media in the form of volatile memory, such as Random Access Memory (RAM), and/or non-volatile memory, such as Read Only Memory (ROM) or flash RAM. The memory 110 can further be part of one or more hard drives. The memory 110 typically includes program modules 206 and/or program data 210 for conducting a player interactive lottery is immediately accessible to and/or presently operated on by the processor 108. In one embodiment, the program modules 206 include a winning determination module 112, a player object module 114, a winning object module 116, and a winning declaration module 118. Other modules 208, such as Operating Systems, may also be included for assisting in the functioning of the server 102. The program data 208 may include player objects 212, winning objects 214, and other program data 216 specific to the system or its applications.

The winning determination module 112 decides winning of a player for each lottery ticket purchased by the player while playing player interactive lottery. The winning of the player is decided the moment the player purchases the lottery ticket. This is primarily because the player interactive lottery pertains to an instant lottery game, wherein the winning information is instant and the winning tickets from the set of total tickets are already fixed before the player purchases the lottery ticket.

The player object module 114 identifies a player set including a set of player objects for each lottery ticket by incorporating at least one interactive game to be played by the player for the lottery ticket. The interactive games can include multiple media-based interactive sporting and/or other events such as, but not limited to, a pool game, a volleyball game, a football game, a tennis game, a race (run, car, and bike), a throw game, and a golf game. The player set is identified based on an outcome of the interactive game where the outcome of the interactive game is based on skill of the player to play the interactive game.

The winning object module 116 discloses a winning set including a set of winning objects to a player for a lottery ticket. In an embodiment, the winning set can be disclosed through an interactive game, wherein the interactive game can also used by the player object module 114 to identify a set of player objects. The set of winning objects can be disclosed based on the set of player objects identified by the player object module 114, the winning of the player for the lottery ticket decided by the winning determination module 112, and winning criteria. In another embodiment, the winning objects are disclosed one at a time after identification of each player object through the interactive game. Such disclosure of winning objects is done by incorporating intelligence into the winning object module 116 so that, taking into consideration the winning criteria, the winning determined by the winning determination module 112 is achieved.

In another embodiment, the winning determination module 112 determines a set of player objects for a lottery ticket the moment a player purchases the lottery ticket. The winning determination module 112 can determine the set of player objects based on winning criteria and winning of the player for the lottery ticket decided by the winning determination module 112. The player object module 114 can then reveal the same set of player objects by incorporating at least one interactive game to be played by the player for the lottery ticket. The set of player objects can be revealed upon a set of actions by the player while playing the interactive game, wherein the set of actions by the player are based on skill of the player to play the interactive game.

For instance, consider that a player interactive lottery incorporates a winning criterion of match same numbers, wherein a player wins the lottery based on the number of times a player number appears in a player set. Assume that the player interactive lottery incorporates a pool based interactive game and the winning determination module 112 determines the winning of a player for a specific lottery ticket as $200 on matching of three player numbers in the player set of five numbers and determines the player set as {12, 23, 12, 9, 12}, wherein the winning of the player and player set are determined the moment the player purchases the lottery ticket. The player object module 114 can then reveal the same set of player numbers in the same and/or different order through the pool based interactive game each time the player pots a ball, wherein the action of potting the ball is based on the skill of the player to play the pool based interactive game.

In yet another embodiment, the winning determination module 112 determines a set of player objects and a set of winning objects for a lottery ticket the moment a player purchases the lottery ticket. The winning determination module 112 can determine the set of player objects and the set of winning objects based on winning criteria and winning of the player for the lottery ticket decided by the winning determination module 112. The player object module 114 can then reveal the same set of player objects by incorporating at least one interactive game to be played by the player for the lottery ticket. The set of player objects can be revealed upon a set of actions by the player, wherein the set of actions by the player are based on skill of the player to play the interactive game.

For instance, consider that a player interactive lottery incorporates a winning criterion of add player numbers to match fixed winning numbers, wherein a set of winning numbers, say {7, 11, 21} can be determined by the winning determination module 112 based on the winning criterion, and a player wins the lottery if the sum of player numbers for a lottery ticket is equal to either of the winning numbers. Consider that the player interactive lottery incorporates a pool based interactive game, wherein the winning determination module 112 determines the winning of a player for a lottery ticket as $0 (the sum of player numbers do not match any of the winning numbers), the winning set as {7; 11, 21}, and the player set of 5 numbers as {3, 5, 6, 8, 1} the moment the player purchases the lottery ticket. The player object module 114 can then reveal the same set of player objects, one by one, in the same and/or different order through the pool based interactive game each time the player pots a ball, wherein the action of potting the ball is based on the skill of the player to play the pool based interactive game.

The winning declaration module 118 declares winning, decided by the winning declaration module 112, to a player for a lottery ticket. In an embodiment, the winning can be declared to the player after the interactive game and can be based on the player set, the winning set, and the winning criteria.

Figure 3:
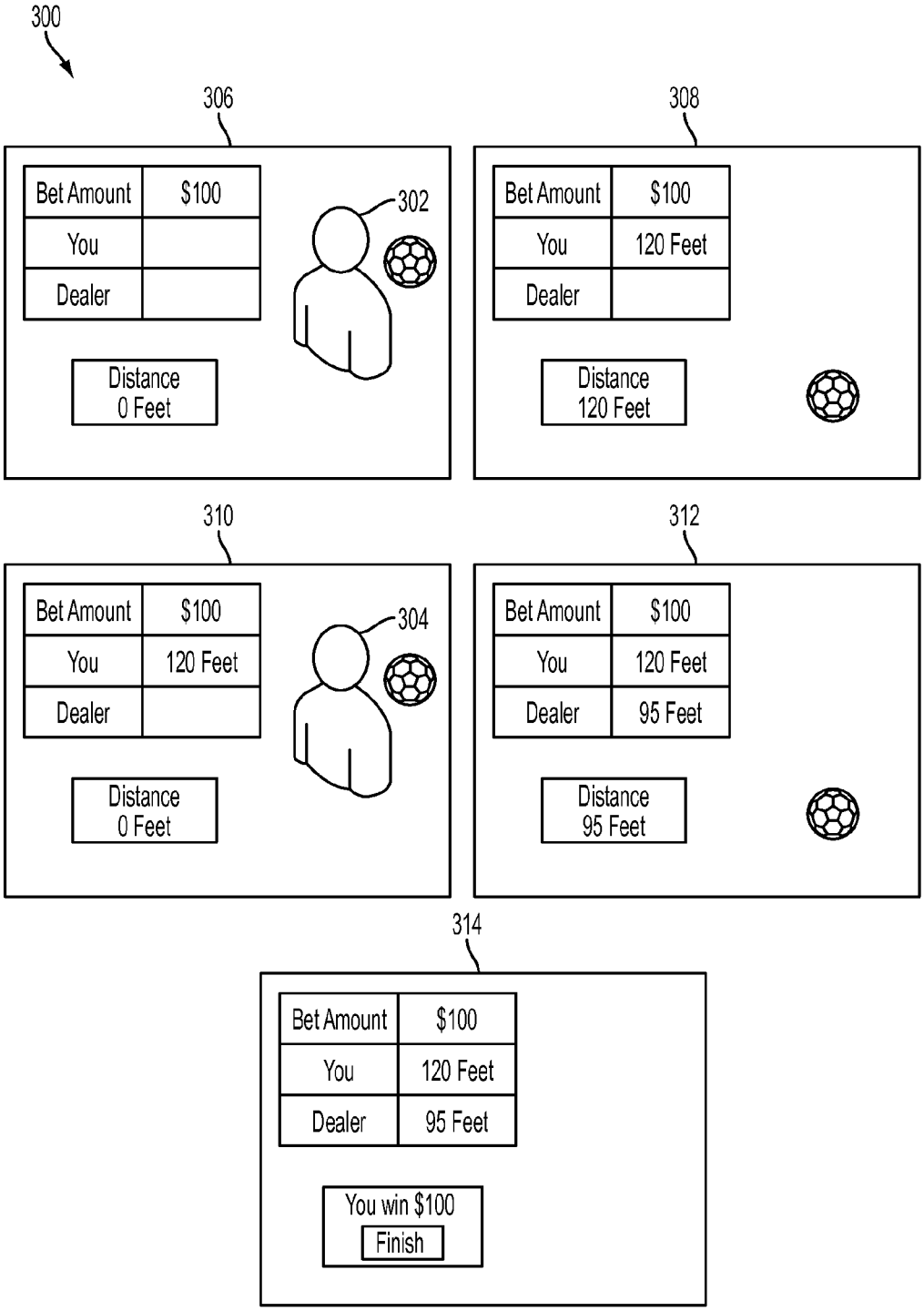
FIG. 3 illustrates an exemplary diagram depicting a player interactive lottery incorporating a throw ball based interactive game

FIG. 3 illustrates an exemplary diagram depicting a player interactive lottery incorporating a throw ball based interactive game. The diagram illustrates a player 302 playing the lottery through the interactive game, wherein the throw ball game is based on his skill to throw the ball as far as possible.

In an embodiment, consider that winning criterion for the player interactive lottery is based on player number higher than winning number, wherein the player 302 wins the lottery if his player numbers are higher than the winning numbers disclosed by the wining object module 116 through a dealer 304. FIG. 3 depicts the player interactive lottery to be played for one player number, which is then be compared with a disclosed winning number to declare the same winning as is determined the moment the player purchases lottery ticket.

The winning determination module 112 determines a winning for $100 for the lottery ticket of the player, wherein the winning of $100 is determined the moment the player purchases the lottery ticket. Consider that the winning of $100 corresponds to the player number being higher than the winning number. At 306, the player 302 begins to throw the ball using the throw ball interactive game. At 308, the player number of the player 302 is identified by the player object module 114 based on the skill of the player to throw the ball as far as possible. The player number identified by the player object module 114 is 120.

At 310, the dealer 304, playing on behalf of the player interactive lottery system, begins to throw the ball to disclose the winning number. At 312, the winning number is disclosed by the winning object module 116 based on the player number, the winning of $100 determined by the winning determination module 112, and the winning criterion of player number higher than winning number. The winning number disclosed by the winning object module 116 is 95. At 314, the winning declaration module 118 declares the winning of $100 to the player 302 based on the player number which is 120, the winning number which is 95, and the winning criterion.

Exemplary Methods

Exemplary methods for conducting a player interactive lottery are described with reference to FIGS. 1-3. These exemplary methods can be described in the general context of computer executable instructions. Generally, computer executable instructions can include routines, programs, objects, components, data structures, procedures, modules, functions, and the like that perform particular functions or implement particular abstract data types. The methods can also be practiced in a distributed computing environment where functions are performed by remote processing devices that are linked through a communication network. In a distributed computing environment, computer executable instructions may be located both in local and remote computer storage media, including memory storage devices.

The exemplary methods are illustrated as a collection of blocks in a logical flow graph representing a sequence of operations that can be implemented in hardware, software, firmware, or a combination thereof. The order in which the methods are described is not intended to be construed as a limitation, and any number of the described method blocks can be combined in any order to implement the methods, or alternate methods. Additionally, individual blocks may be deleted from the methods without departing from the spirit and scope of the subject matter described herein. In the context of software, the blocks represent computer instructions that, when executed by one or more processors, perform the recited operations.

Figure 4:
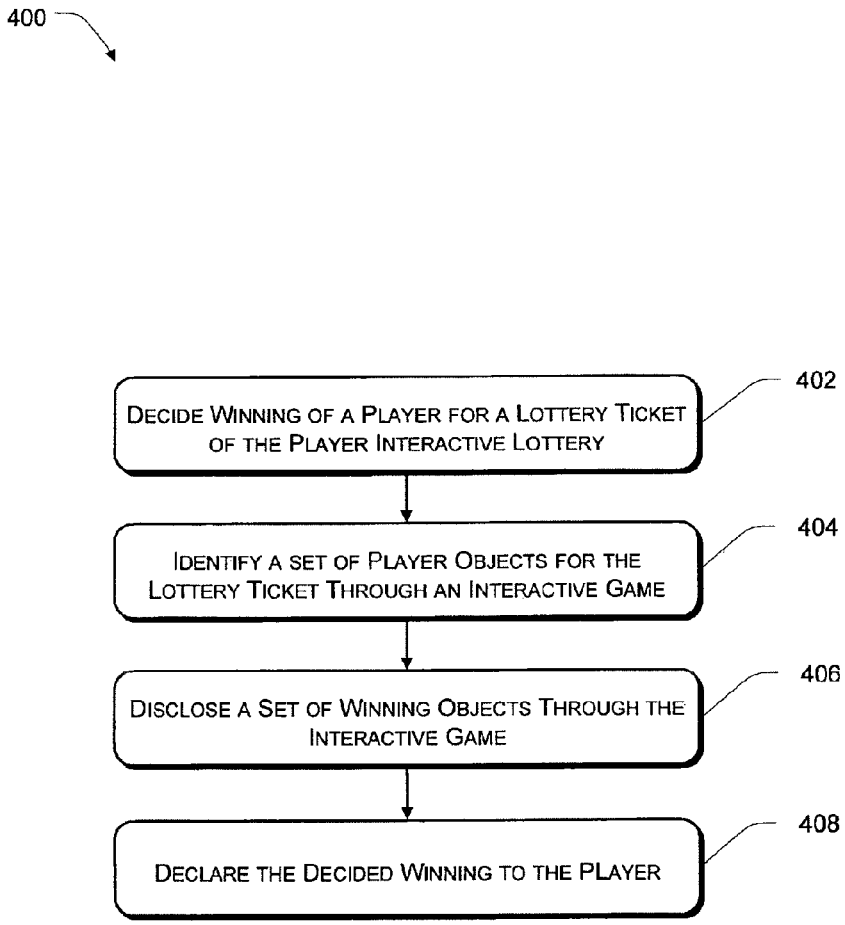
FIG. 4 illustrates exemplary method(s) for conducting a player interactive lottery having player objects and winning objects determined from an interactive game.

FIG. 4 illustrates exemplary method(s) for conducting a player interactive lottery having player objects and winning objects determined from an interactive game.

At block 402, winning of a player is decided for a lottery ticket of the player interactive lottery, wherein the winning is decided the moment the player purchases the lottery ticket.

At block 404, a set of player objects is identified by the player object module 114. The set of player objects is identified by incorporating at least one interactive game to be played by the player for the lottery ticket. The set of player objects is identified based on an outcome of the interactive game, wherein the outcome of the interactive game is based on skill of the player to play the interactive game.

A block 406, the winning object module 116 discloses a set of winning objects to the player for the lottery ticket through the interactive game. The set of winning objects is disclosed based on the set of player objects identified by the player object module 114, the decided winning of the player for the lottery ticket, and winning criteria.

At block 408, the winning declaration module 118 declares the winning, decided by the winning determination module 112 at block 402, to the player based on the set of player objects, the set of winning objects, and the winning criteria.

Figure 5:
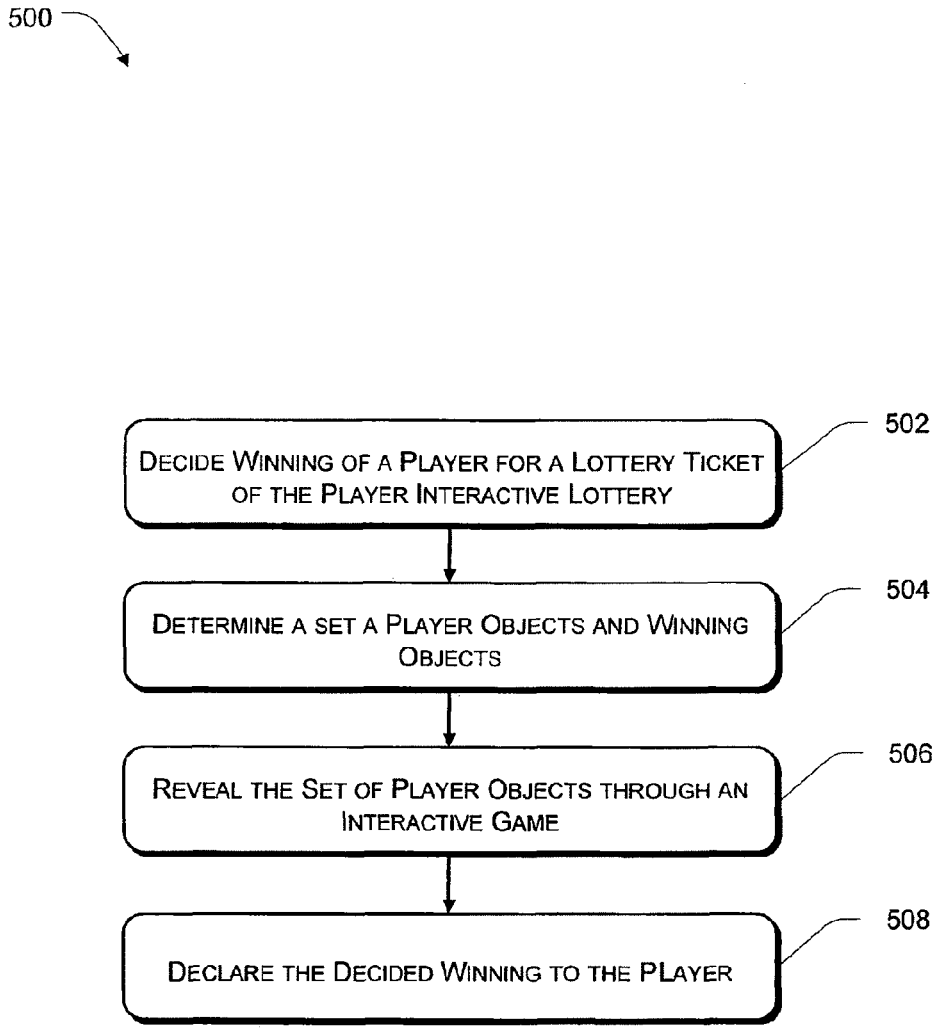
FIG. 5 illustrates exemplary method(s) for conducting a player interactive lottery having player objects determined from an interactive game.

FIG. 5 illustrates exemplary method(s) for conducting a player interactive lottery having player objects determined from an interactive game.

At block 502, the winning declaration module 112 decides winning of a player for a lottery ticket of the player interactive lottery, wherein the winning is decided the moment the player purchases the lottery ticket.

At block 504, the winning declaration module 112 determines a set of player objects and a set of winning objects for the lottery ticket the moment the player purchases the lottery ticket. The set of player objects and the set of winning objects are determined based on winning criteria and the winning decided by the winning declaration module 112 at block 502. In an embodiment, the winning declaration module 112 determines only a set of player objects based on winning criteria and the winning decided by the winning declaration module 112 the moment the player purchases the ticket.

At block 506, the set of player objects is revealed to the player by incorporating at least one interactive game to be played by the player for the lottery ticket, wherein the set of player objects is revealed upon a set of actions by the player. The set of actions by the player can be based on skill of the player to play the interactive game.

At block 508, the winning declaration module 118 declares the winning decided by the winning determination module 112 for the lottery ticket to the player based on the set of player objects, the set of winning objects, and the winning criteria. In an embodiment, in case the winning determination module 112 determines only a set of player objects based on the winning criteria and the decided winning, and does not determine a set of winning objects, the winning declaration module 118 declares the winning to the player based on the set of player objects and the winning criteria.

Although various implementations of the described subject matter have been described in language specific to structural features and/or methodological operations, it is to be understood that the subject matter defined in the appended claims is not necessarily limited to the specific features or steps described. Rather, the specific features and operations are disclosed as exemplary forms of implementing the claimed subject matter.

Advantages of the Invention

1. The present invention relates to systems and methods of conducting a player interactive lottery that makes the instant lottery games more interesting and interactive for the player through incorporation of multiple skill based interactive games.

2. The present invention clearly determines and discloses winning of a player for a specific lottery ticket based on a set of player objects and a set of winning objects through incorporation of one more skill based interactive games.

3. The present invention incorporates an intelligence through which the player interactive lottery system adapts to the skill displayed by the player to player interactive games, so as to disclose the same winning as is determined the moment the player purchases the lottery ticket.

We claim:

1. A method of conducting a player interactive lottery online in which a server provides a player interactive game that allows interaction with one or more client devices that are operatively coupled with the server through a network, wherein said player interactive game is a game of skill, and wherein said one or more client devices participate in the player interactive lottery allowing a processor that is coupled to a memory to determine a set of winning objects during the course of the player interactive game comprising, the steps of:

deciding winning of a player for a lottery ticket of the player interactive lottery at said server, wherein the winning is decided the moment the player purchases the lottery ticket;

identifying a set of player objects, at said one or more client devices, by incorporating said game of skill to be played by the player for the lottery ticket, wherein the set of player objects is identified based on an outcome of said game of skill, further wherein the outcome of the game of skill is based on skill of the player to play the player interactive game;

disclosing a set of winning objects corresponding to said set of player objects, at said server, to the player for the lottery ticket through the game of skill, wherein the set of winning objects is disclosed based on the set of player objects, the decided winning of the player for the lottery ticket, and winning criteria; and declaring the decided winning to the player for the lottery ticket based on the set of player objects, the set of winning objects, and the winning criteria.

2. The method as claimed in claim 1, wherein the set of player objects and the set of winning objects in the player interactive lottery is selected from objects comprising of numbers, symbols, letters, sportive symbols, events, and interactive objects.

3. The method as claimed in claim 1, wherein an automatic play option is given to the player while playing the player interactive lottery, further wherein the player can select the automatic play option and skip playing the interactive game to determine the decided winning for the lottery ticket.

4. The method as claimed in claim 1, wherein at least one of promotional money, gift in kind, or gift in monetary terms is given to the player in addition to said decided winning of the player based on the skill of the player to play the interactive game.

5. A system for conducting a player interactive lottery, comprising a memory;

one or more processors operatively coupled to the memory;

a winning determination module configured to decide winning of a player for a lottery ticket of the player interactive lottery, wherein the winning is decided the moment the player purchases the lottery ticket;

a player object module configured to identify a set of player objects of the lottery ticket by incorporating at least one skill-based interactive game to be played by the player for the lottery ticket, wherein the set of player objects is identified based on an outcome of the skill-based interactive game, further wherein the outcome of the skill-based interactive game is based on skill of the player to play the interactive game;

a winning object module configured to disclose a set of winning objects to the player for the lottery ticket through the skill-based interactive game, wherein the set of winning objects is disclosed based on the set of player objects, the decided winning of the player for the lottery ticket, and winning criteria; and a winning declaration module configured to declare the decided winning to the player for the lottery ticket based on the set of player objects, the set of winning objects, and the winning criteria.

6. The system as claimed in claim 5, wherein an automatic play option is given to the player while playing the player interactive lottery, further wherein the player can select the automatic play option and skip playing the interactive game to determine the decided winning for the lottery ticket.

7. The system as claimed in claim 5, wherein the player interactive lottery is played on at least one of an electronic media, a PC, a mobile device, a computing device, and a paper.

* * * * *